United States Patent [19]

Nelson

[11] 4,332,367

[45] Jun. 1, 1982

[54] BLOWOUT PREVENTER HAVING A VARIABLE RAM SEAL

[75] Inventor: Norman A. Nelson, Houston, Tex.

[73] Assignee: NL Industries, Inc., New York, N.Y.

[21] Appl. No.: 146,077

[22] Filed: May 2, 1980

[51] Int. Cl.[3] ..... E21B 33/06

[52] U.S. Cl. ..... 251/1 A; 277/188 A; 277/192

[58] Field of Search ..... 251/1 A, 1 B; 277/30, 277/31, 188 R, 188 A, 192

[56] References Cited

U.S. PATENT DOCUMENTS

| | | | |
|---|---|---|---|
| 1,989,429 | 1/1935 | Segezhorst et al. | 251/1 A |
| 3,434,729 | 3/1969 | Shaffer et al. | 251/1 A |
| 3,572,628 | 3/1971 | Jones | 251/1 B |
| 3,667,721 | 6/1972 | Veyasinovic | 251/1 |
| 3,736,982 | 6/1973 | Veyasinovic | 166/55 |
| 3,946,806 | 3/1976 | Meymer | 251/1 A |
| 4,044,988 | 8/1977 | Arzumanov et al. | 251/1 A |
| 4,089,532 | 5/1978 | Kamyshnikov et al. | 251/1 A |
| 4,099,699 | 7/1978 | Allen | 251/1 B |
| 4,229,012 | 10/1980 | Williams | 277/127 |

FOREIGN PATENT DOCUMENTS

| | | | |
|---|---|---|---|
| 839339 | 6/1960 | United Kingdom | 251/1 A |

*Primary Examiner*—H. Jay Spiegel

[57] ABSTRACT

A blowout preventer is disclosed as including a ram-type seal element which can be compressed and deformed to seal around a variety of pipe sizes. The seal element is molded from a resilient rubber material and includes a generally semicircular section to sealingly engage pipes. A plurality of metallic support elements are embedded in the seal to support the rubber material for deformation essentially only in a radial inward direction to conform to the drill string pipe size, when force is applied to the seal by the ram hydraulic system.

12 Claims, 8 Drawing Figures

FIG. 8
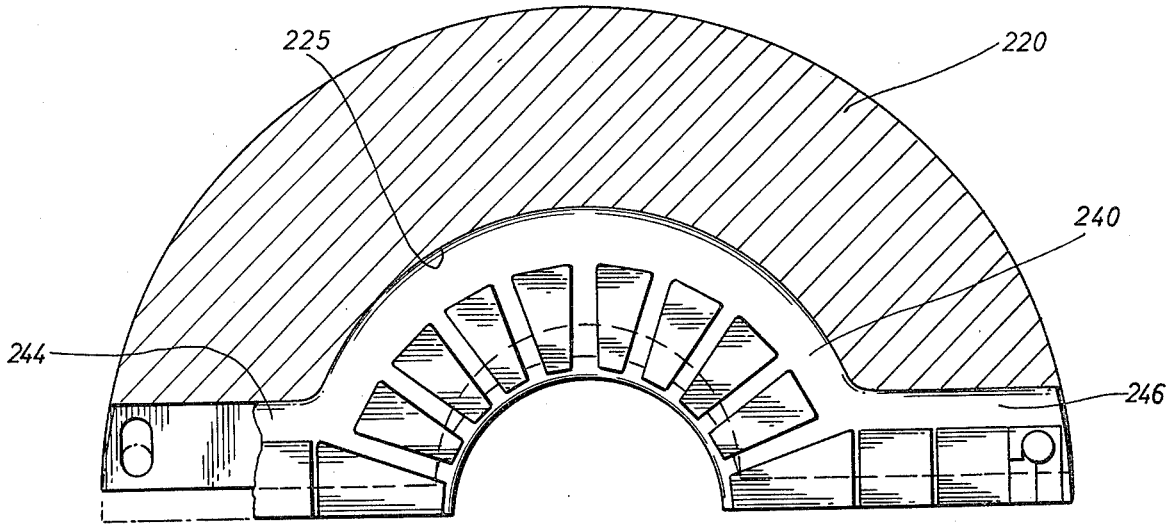
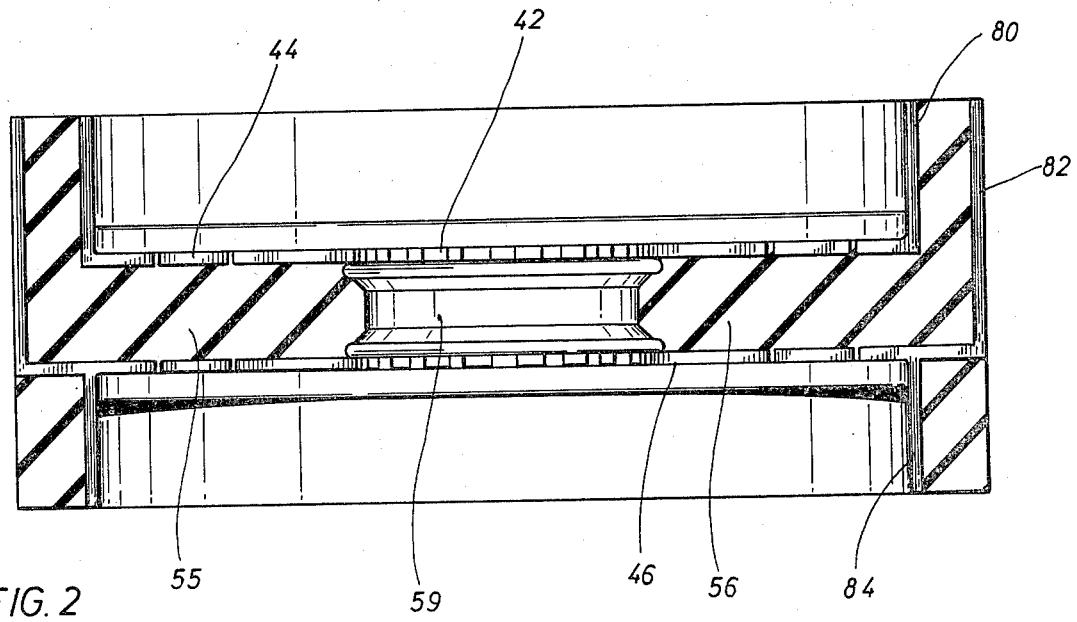
FIG. 2

FIG. 4
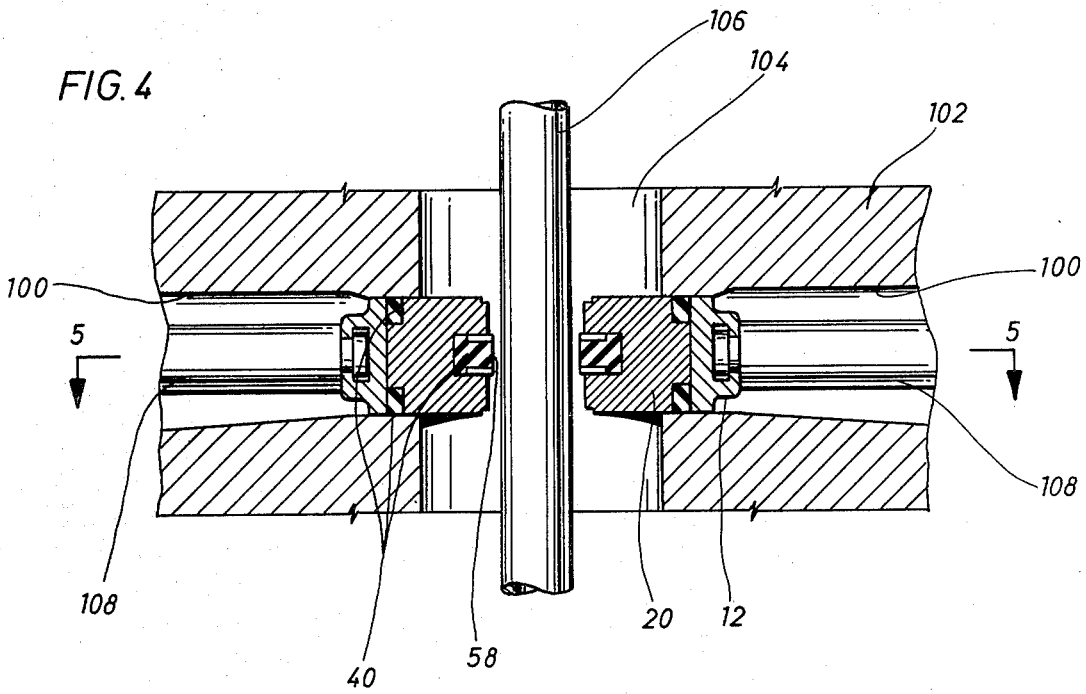
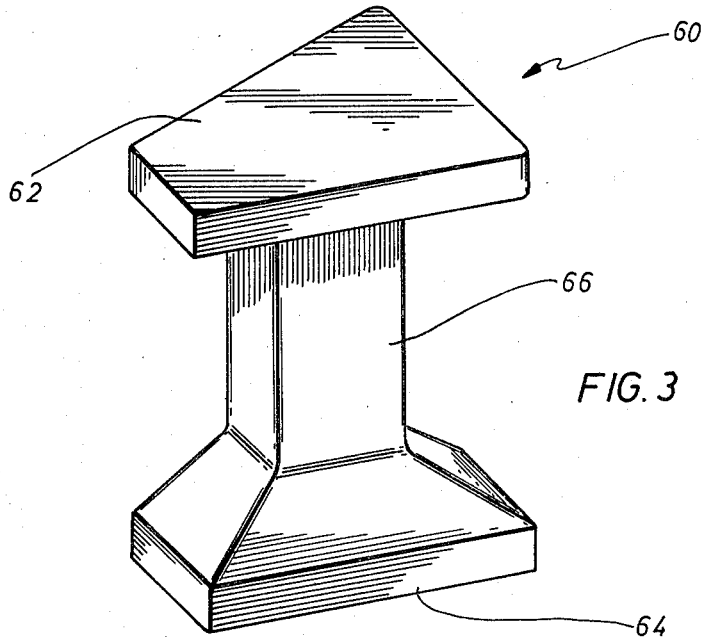
FIG. 3

BLOWOUT PREVENTER HAVING A VARIABLE RAM SEAL

BACKGROUND OF THE INVENTION

1. Field of the Invention

The present invention relates generally to blowout preventers forming a part of well drilling equipment, as used for example in the drilling for oil and gas. More particularly, this invention relates to a sealing element for a ram-type blowout preventer, wherein the seal element is compressible to accommodate a range of drill pipe sizes.

2. The Prior Art

During drilling for oil and gas, instances occur when the drill string must be sealed to prevent damage to the well and associated equipment. Various types of blowout preventer equipment have been used in the past to provide such a seal. For example, U.S. Pat. No. 3,736,982 discloses shear-type and ram-type blowout preventers; and U.S. Pat. No. 3,667,721 discloses a spherical-type blowout preventer.

Generally speaking, the ram-type blowout preventer is preferred in certain circumstances because of its longer life expectancy than the spherical-type blowout preventer. However, governmental restrictions now require that two ram-type blowout preventers must be used per pipe size. This becomes significant when drilling at greater depths, since tapered drill strings are employed using various sized pipes. Therefore, several of the prior types of blowout preventers are required in these circumstances, since the seal elements of those prior ram-type preventers can accommodate only one size of pipe.

The present invention is directed to a variable ram seal for a blowout preventer that can be used with various sized pipes, and thereby provide the advantages set forth later in this disclosure. One variable ram seal has already been marketed. However, that particular ram includes steel support elements molded into the rubber such that the support elements rotate inwardly much like the shutter elements in a camera. This type of movement is believed to create unnecessary degrees of stress in the seal element, which can potentially create wear for a relatively short life expectancy.

SUMMARY OF THE INVENTION

The present invention overcomes the shortcomings in the prior art with a blowout preventer which includes a compressible seal element capable of use with a variety of pipe sizes. The compressible seal element includes an arcuate section comprised of a resilient, compressible material and including an inward radial projection to seal against the pipe. Several rigid support elements are embedded in the arcuate seal section to prevent rubber extrusion. These support elements are radially positioned around the arcuate seal section and are circumferentially spaced from each other by a distance sufficient to accommodate compression of the arcuate section to engage different sized pipes but yet to support the arcuate section. Each support element includes a pair of essentially parallel support sections that are positioned on opposed sides of the arcuate seal section, with these support sections being interconnected by an integral web embedded in the compressible material. Due to this arrangement, the resilient compressible material and the support elements move essentially radially inward upon the application of a radial compression force, to accommodate sealing around various sized pipes.

In a preferred aspect of the invention, the arcuate section of the compressible seal is essentially semicircular. Also included is an outwardly directed radial flange section at each terminal end of the semicircular section, with these flanges also being comprised of a resilient compressible material. Each flange section likewise includes a plurality of rigid support elements which include a pair of essentially parallel sections on opposed sides of the flange and a web embedded in the compressible material and interconnected with both the support sections.

In one preferred embodiment, the seal also includes an end section at the terminal end of each flange. Each of these end sections extend essentially perpendicular to the flange and to each side of the flange, with a pair of spaced, resilient, compressible elements extending from one end section to the other in a generally semicircular configuration.

In a second preferred embodiment, a generally annular shaped, semicircular block member supports the seal assembly in a blowout preventer. The block includes a first recess around its outer periphery at one of its edges to define a generally semicircular surface and a generally semicircular ledge to receive a first seal element. A second recess on the inner surface of the block receives and supports a second seal element. The first seal element is generally semicircular, and the second seal element is semicircular and including outwardly directed radial flanges as previously described as including the plurality of rigid support elements.

In another aspect of the second embodiment, the second seal element includes an opening therethrough essentially parallel to its sealing face adjacent the end of each flange in alignment with corresponding openings in the block. The first seal element includes a pin adjacent each of its ends, with the pins extending essentially perpendicular to the plane of this seal element to fit through a corresponding opening in the second seal element and the block.

The blowout preventer of this invention will include a body member having a well bore for the reception of a drill string. A plurality of ram chambers is also provided in the body in a plane essentially perpendicular to the well bore to receive a ram assembly including a holder, a ram block, and a compressible ram seal element as previously described.

Accordingly, the present invention provides various advantages over the prior art. Since the seal assembly of this invention can close on a variety of pipe sizes, the numbers of seals required for a drilling operation is reduced, particularly when drilling at great depths and using a tapered drill string. The present invention therefore can reduce the investment cost and changeover time. Further, the present invention can reduce the number of rams required, since there is no longer a necessity to have two rams for each pipe size. Also, the seal element of this invention is designed to endure the stresses created during compression to seal around smaller size pipes.

These and other advantages and meritorious features will be more fully appreciated from the following detailed description and the attached claims.

BRIEF DESCRIPTION OF THE DRAWINGS

FIG. 2 is a frontal view of the seal element illustrated in FIG. 1.

FIG. 3 is a perspective view of a support element embedded in the seal member for supporting the resilient material of the seal against extrusion during compression to fit various sized pipes.

FIG. 4 is a cross-sectional view illustrating the seal and block assembly for FIG. 1 as installed in a ram body for use in a well bore.

FIG. 8 is a partial cross-sectional top view of the seal component of FIG. 7 as positioned in a ram block.

DETAILED DESCRIPTION OF THE PREFERRED EMBODIMENTS

The present invention relates to a compressible, resilient ram-type seal for use in a blowout preventer. The seal element of this invention is adapted for use with a variety of sizes of pipes. In general, the invention includes an arcuate seal section which has an inner radius of curvature corresponding to the largest pipe that can be sealed with this element. The arcuate section, however, is capable of being radially compressed to seal around smaller pipe sizes.

The Embodiment of FIGS. 1–6

Figure 1:
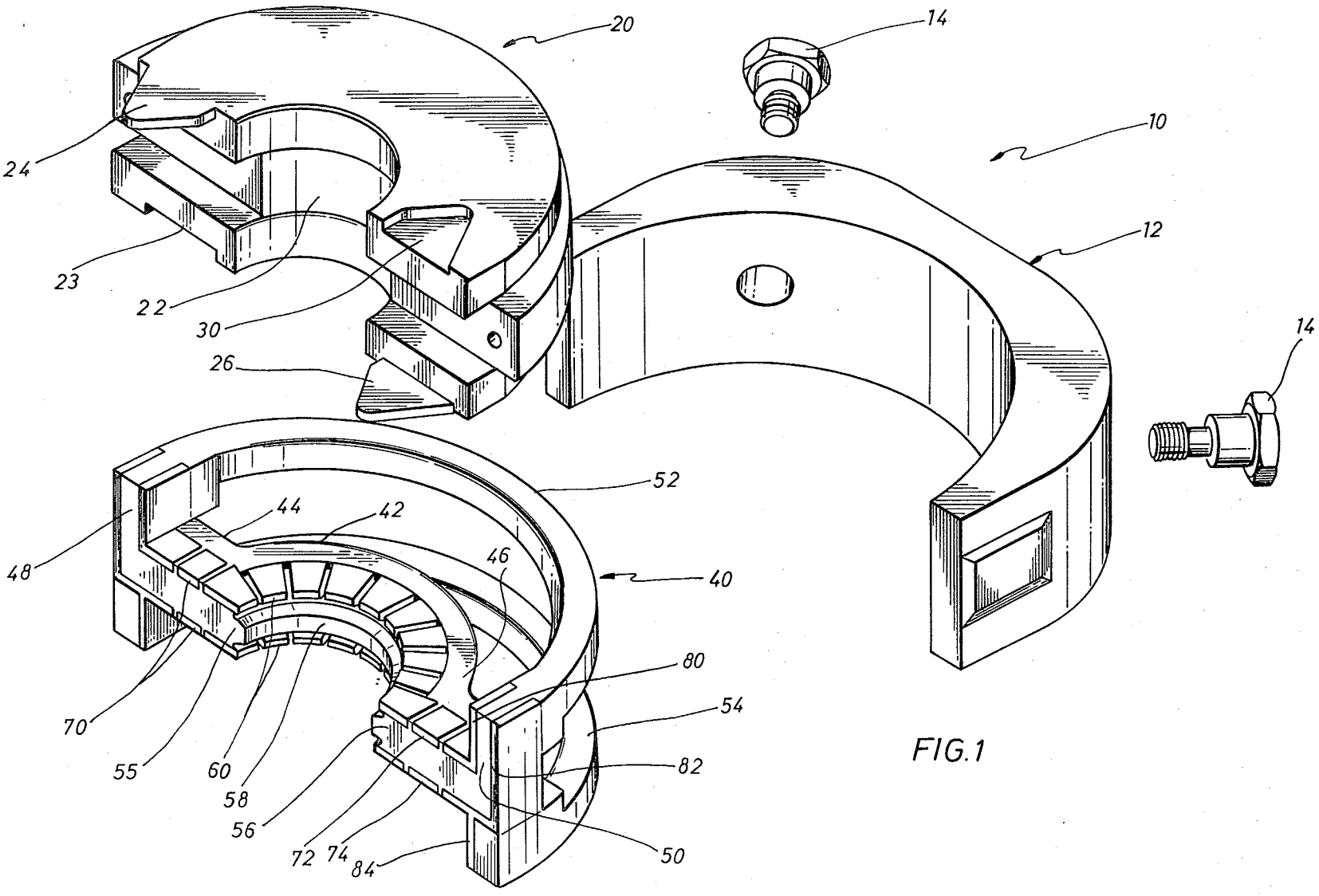
FIG. 1 is an exploded perspective view of one embodiment of the invention, illustrating a seal element in combination with a ram block and a holder.

Referring now to FIG. 1, a ram assembly 10 is illustrated as including a holder 12, a ram block 20, and a seal element 40. When assembled, the seal 40 fits around the block 20, and the seal and block are retained in the holder 12. As shown in FIG. 4, in use the ram assembly is positioned within a ram chamber 100 of a ram body 102. Typically, a pair of ram chambers are provided in the body 102 at diametrically opposed positions with respect to a well bore 104 which receives a drill string 106. Each ram assembly 10 is moved radially inwardly and outwardly by a ram shaft 108 which is connected to a piston and cylinder arrangement (not shown).

The ram holder is essentially C-shaped to receive the ram block 20 and seal component 40. A pair of retracting screws 14 fit through bores in the body of the holder and into corresponding threaded bores in the ram block in order to releasably secure the ram block in the holder. The holder is comprised of a suitable steel material for transmitting forces from the ram shaft to the seal component.

The ram block 20 is generally annular and semicircular, including a recess 22 in its forward face to receive an essentially complementary-shaped portion of the seal 40. Projections 24 and 26 are provided on the block to fit within complementary-shaped recesses of the opposing block for centering purposes. Likewise, block 20 also includes generally triangular-shaped recesses 23 and 30 to receive centering projections of the opposed block. The ram block is preferably a one piece cast item comprised of an alloy steel, suitable for use in a drilling environment.

The seal element 40 is best illustrated in FIGS. 1, 2, 5 and 6 as including an arcuate, generally semicircular section 42 and a pair of flanges 44 and 46 which extend radially outwardly from the ends of the arcuate section 42. End sections 48 and 50 extend to both sides of the terminal ends of each flange. Generally semicircular components 52 and 54 extend from respective sides of the end sections 48 and 50. Seal element 40 is comprised of a compressible resilient material, such as nitrile rubber, except as will be described later in connection with metallic support elements.

Figure 5:
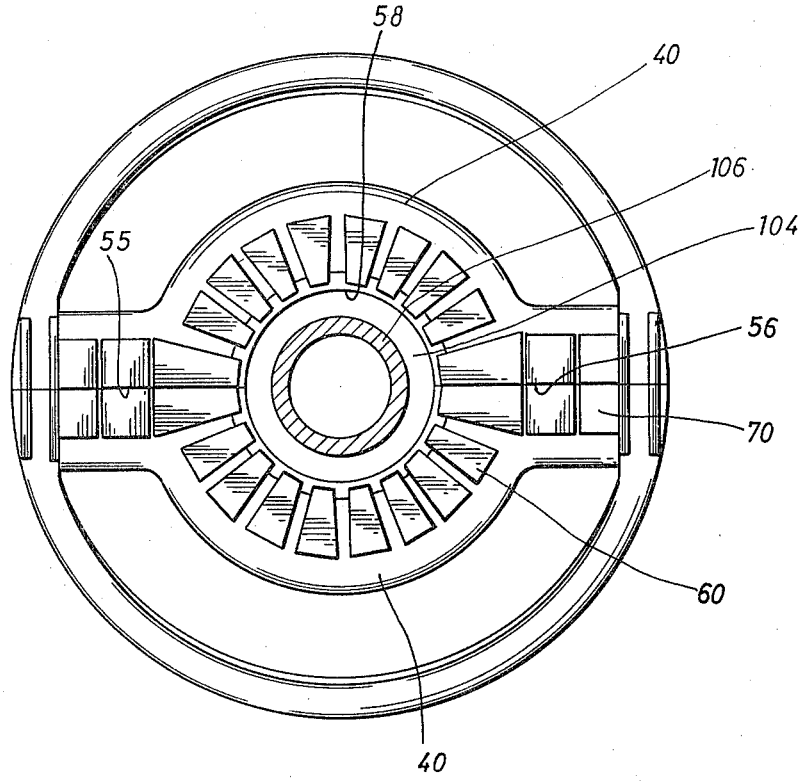
FIG. 5 is a cross-sectional view taken along plane 5—5 as shown in FIG. 4, illustrating the seal element as the faces thereof come into abutment prior to compression of the seal to close around a pipe having an outer diameter smaller than the inner diameter of the seal.
Figure 6:
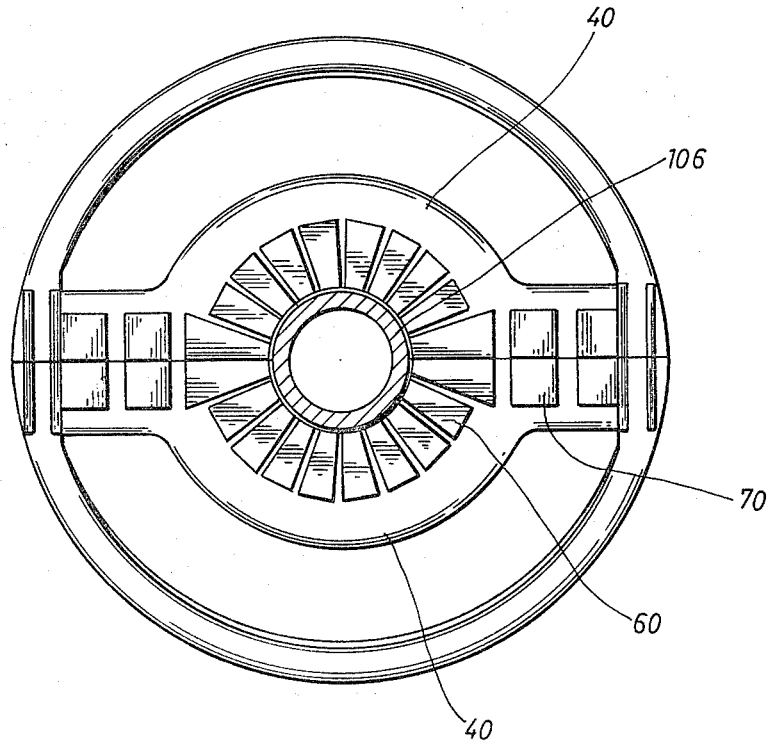
FIG. 6 is an illustration similar to that of FIG. 5, but illustrating compression of the seal elements to close around a pipe.

As best shown in FIGS. 2, 3, 5, and 6, a plurality of support elements 60 are provided in the arcuate section 42 of the seal 40. These support elements 60 are embedded in the compressible material when the seal is made by molding. As best shown in FIG. 3, these elements include a pair of essentially parallel support sections 62 and 64 that are positioned on opposed sides of the arcuate seal section 42. These support element sections 62 and 64 are interconnected by an integral web 66 which is embedded in the compressible material and extends through the seal essentially parallel to the axis of the arcuate seal section. These support elements are preferably made out of steel, and the sections 62 and 64 are preferably truncated wedge-shaped to accommodate their positioning in the seal. As best shown in FIGS. 5 and 6, the support elements are radially positioned; that is, the web element is positioned essentially on a radius with respect to the axis of the arcuate seal section 42. Additionally, as best illustrated in FIG. 3, the web 66 is essentially rectangular in cross section so that it includes a pair of major axis, one of which is essentially positioned on a radius with respect to the axis of the arcuate seal section 42. Also, these support elements are circumferentially spaced from each other by a distance sufficient to accommodate the compression of the arcuate seal section when sealing upon smaller pipes, yet the support elements are spaced close enough to support the compressible material against extrusion during compression. In the preferred embodiment, the radius of the arcuate seal section 42 is about $2\frac{1}{2}$ inches, such that a pair of seal elements will close and seal on a drill pipe of about 5 inches without deformation of the arcuate seal element. As currently designed, a pair of seal elements are compressible to seal on pipes down to $3\frac{1}{2}$ inches in diameter. In this particular size, each section 62 of a support element 60 is spaced approximately $\frac{1}{4}$ of an inch from the next adjacent support element section.

Each flange section 44 and 46 also includes a plurality of support elements 70. These support elements are somewhat similar to the support elements 60, except for the configuration of the spaced support sections. More specifically, each support element 70 includes a pair of generally parallel support sections 72 and 74 on opposed sides of the flange. These sections 72 and 74 are interconnected by a web of material (not shown) which may be similar to component 66. The support sections 72 and 74 are generally rectangular shaped, and may be positioned in abutting relationship to a next adjacent support section of a similar element. This placement results from the phenomenon that the compressible, resilient material of the seal in the region of the flange is placed in tension and is compressed radially inwardly when the seal element is compressed to seal on a smaller size pipe. Therefore, the support elements 70 move away from each other in this phase of operation, rather than moving closer together as is the case with the support element 60.

Seal component 40 also includes support elements 80, 82, and 84 embedded in the resilient material in the region of each end section. These support elements are provided for stability in the region of the end section adjacent the flanges, but these support elements preferably do not extend around the semicircular seal section 52 from one end portion to the other.

Referring now more particularly to FIGS. 4–6, the operation of the seal component 40 will be described in connection with its compression to seal on a pipe having an outer diameter smaller than that of the diameter of the arcuate seal section 42 in the relaxed, undeformed condition. FIGS. 4 and 5 illustrate a pair of opposed seal components 40 at the moment when opposed face seal sections 55 and 56 on flanges 44 and 46 abut. At this particular moment, an inward radial projection section 58 on the arcuate seal section 42 has not yet sealed against the drill string 106. As force continues to be exerted on the ram block 20 by ram shaft 108 and holder 12, the arcuate section is inwardly compressed and deformed, such that the resilient compressible material in the arcuate section 42 and the support elements 60 travel essentially radially inward to the point where the seal projection 58 engages and seals upon the drill string 106. During this compression, the spacing between adjacent support components 60 decreases, whereas the distance between support components 70 increases. As previously discussed, this is a result of the compressible material being placed in tension in a radial direction in the region of the flanges, but being placed in compression in the region of the arcuate seal section.

When it is no longer necessary to exert a sealing pressure, shaft 108 is retracted. During the initial release of pressure, the arcuate seal section and the flanges revert from the condition shown in FIG. 6 back to the condition shown in FIG. 5. Thereafter, the opposed seal elements and block assemblies are withdrawn back into their respective ram chambers out of the well bore. As is shown in FIG. 4 and is known in the art, the top semicircular element 52 of the seal provides a sealing action against a surface of the ram body in the ram chamber.

Figure 7:
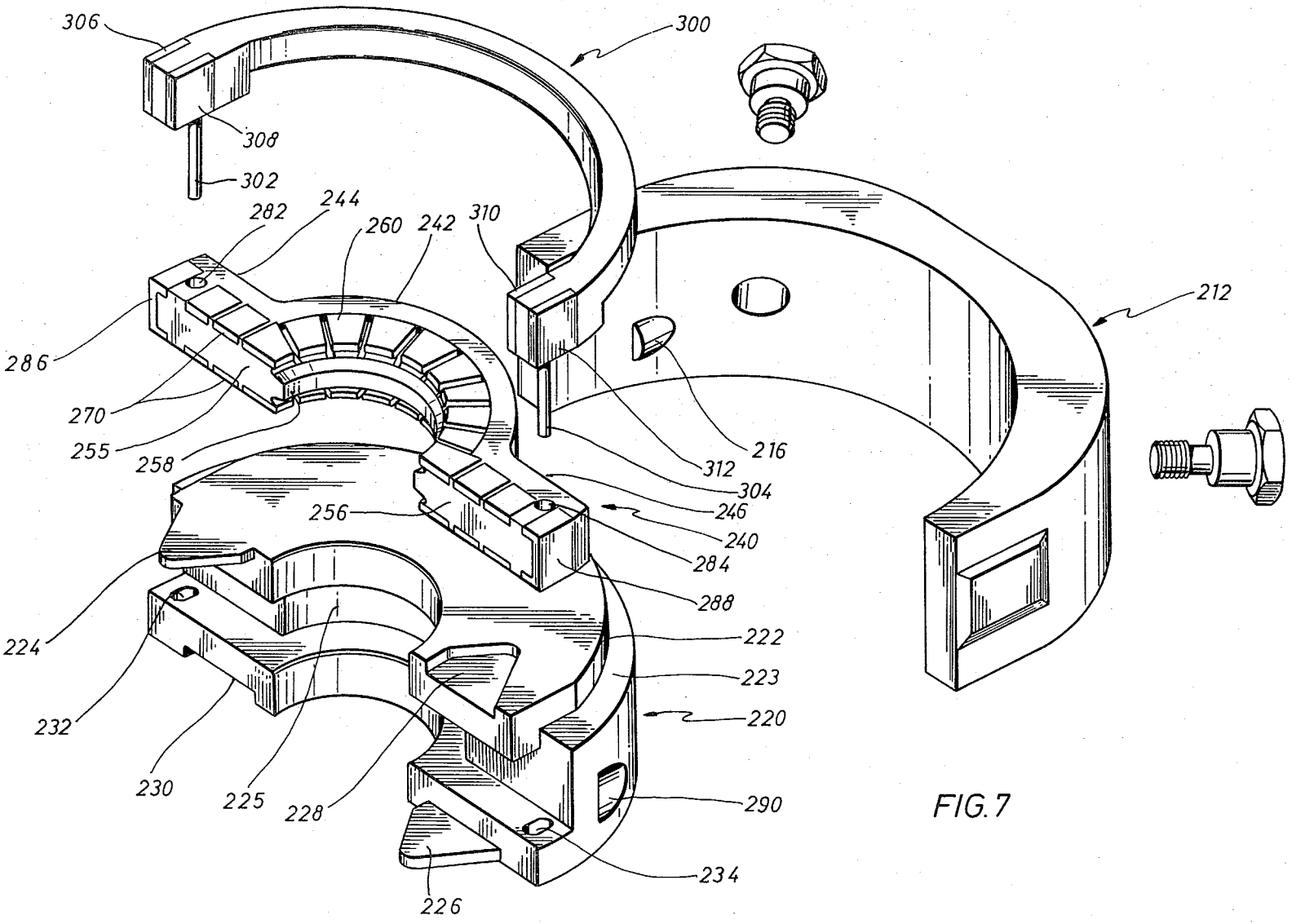
FIG. 7 is an exploded perspective view of a second embodiment of this invention.

The Embodiment of FIGS. 7 and 8

FIG. 7 illustrates in perspective another preferred embodiment, including a ram holder 212, a ram block 220, a seal component 240 and another seal component 300.

Holder 212 is essentially identical to the holder described in connection with reference numeral 12. A pair of inner arched projections 216 (only one shown) fits within complementary shaped recesses 290 (only one shown) in the block 220, for proper positioning purposes.

The block 220 is generally annular shaped and semicircular, including a first recess around its outer periphery at the top outer edge. This recess provides a generally semiannular surface 222 and a generally semicircular ledge 223, which receive and support the seal component 300. A second recess 225 is provided on the inner surface of the block to receive the seal component 240.

The block also includes centering projections and recesses 224, 226, 228 and 230 for alignment purposes, as discussed earlier in connection with similar elements 24, 26, 28, and 30 on block 20. Additionally, block 220 includes a pair of slotted openings 232 and 234 positioned generally parallel to the axis of the block for a purpose to be described later.

Seal component 240 includes a generally semicircular portion 242 and flanges 244 and 246 comprised of a compressible, resilient material. The semicircular section 242 has embedded therein a plurality of support components 260 which may be identical to the components 60 as described in connection with seal 40. That is, these support elements include a pair of generally parallel support sections which are positioned on opposed sides of the semicircular seal region. These support sections are integrally interconnected by a web of steel material, which is embedded in the resilient material. Likewise, the support elements are radially positioned and circumferentially spaced, to support the resilient, compressible material during radially inward compression to seal against smaller pipe sizes.

Likewise, the flanges 244 and 246 have embedded therein a plurality of support elements 270 which may be essentially identical to the support elements 70 as described in connection with the first embodiment. Again, these support elements 270 are preferably placed in abutment, so that during the compressive phase of operation, the compressible material will be supported against extrusion as the support elements are forced radially inward and separate.

The seal element 240 also includes an inward radial projection 258 similar to corresponding component 58, and each flange includes a face seal region 255 and 256 similar to corresponding components 55 and 56 in the embodiment of FIGS. 1–6. Additionally, seal component 240 includes a pair of openings 282 and 284 which extend through the flanges 244 and 246 adjacent their respective ends, for a purpose to be described later. When the seal component 240 is placed in the recess 225, these openings 282 and 284 are preferably in alignment with openings 232 and 234. A pair of generally C-shaped metallic support elements 286 and 288 are provided at the ends of the flanges 244 and 246 to support the compressible material against deformation outwardly.

Seal component 300 is comprised of a suitable resilient, compressible material, such as nitrile rubber, having a generally semicircular configuration. This seal member serves to engage a surface in a ram chamber to provide a sealing function, in the manner disclosed previously in connection with the uppermost component 52 of seal element 40. To properly position the seal component 300 and to hold it in place, pins 302 and 304 are provided at each end of the seal. These pins may be integral with respective pairs of support plates 306, 308, 310, and 312, which are molded into the seal component 300. The pins will extend through respective openings 282 and 284 in seal component 240 and through respective openings 232 and 234 in block 220. Openings 232 and 234 are slotted to accommodate movement of pins 302 and 304 relative to the block during compression of seal component 240.

FIG. 8 illustrates how the seal component 240 nests within the recess 225 of block 220. As illustrated, the back surface of the seal 240 will be flush with the forward surface in the recess 225 of the block. It may be desirable to provide shims between the back surface of the flanges 244 and 246 and the abutting faces of the block 220, in order to provide sufficient pressure in the region of the flanges to establish the desired inward radial movement of the resilient material in the flanges during a compression operation. Otherwise, the operation and use of the embodiment of FIGS. 7 and 8 is essentially identical to the embodiment of FIGS. 1–6, as described particularly in connection with FIGS. 5 and 6.

It will be appreciated by those skilled in the art that various modifications may be made to the two embodiments disclosed herein, without departing from the true spirit and scope of the invention. For example, the sealing component could be used in other environments and could be made such that more than two seal components would be used, for example three, wherein each seal component is approximately an arc of 120°. Alternatively, the seal could be used so that the semicircular section could be expanded or stretched to accomodate larger pipes.

Having therefore completely and sufficiently described our invention, we now claim:

1. A blowout preventer, comprising:

a body member including a well bore for the reception of a drill string and having a plurality of ram chambers in a plane essentially perpendicular to the well bore;

a ram assembly in each of the ram chambers, each ram assembly includng a holder, a ram block releasably secured to the holder, and a compressible ram seal element carried by the ram block, the holder, block and seal being movable as a unit in a respective chamber essentially perpendicular to the well bore, the seal element being capable of use with a variety of pipe sizes and including:

an essentially semicircular section comprised of a resilient, compressible material and including an inward radial projection to seal against a pipe, a plurality of rigid support elements each of which includes a pair of essentially parallel support sections that are positioned on opposed sides of the semicircular section and that are interconnected by an integral web embedded in the compressible material, the web being essentially rectangular in cross section so that it includes a pair of major axis, the support elements being arranged such that the parallel sections and one of the axes of the interconnected integral webs of all the support elements are positioned essentially on a radius with respect to the axis of the semicircular section in their normal uncompressed position and such that the support section of each support element is spaced from the next adjacent support element by a distance sufficient to accommodate compression of the semicircular section, so that the resilient compressible material and the support elements move essentially radially upon the application of radial inward compressible forces, in order to seal around various sized pipes, whereupon during the essentially radial movement of the support elements the parallel sections and integral webs essentially maintain their position on a radius, and radial flange sections extending outwardly from diametrically opposed positions on the semicircular section, each flange section being integral with the essentially semicircular section and including at least one rigid support element in addition to the support elements of the semicircular section, which additional support element includes a pair of essentially parallel sections on opposed sides of the flange and which include an integral web embedded in the compressible material and rigidly interconnected with both the parallel sections.

2. For use in a blowout preventer, a compressible seal element capable of use with a variety of pipe sizes, comprising:

an essentially semicircular section comprised or a resilient, compressible material and including an inward radial projection to seal against a pipe, a plurality of rigid support elements each of which includes a pair of essentially parallel support sections that are positioned on opposed sides of the semicircular section and that are interconnected by an integral web embedded in a compressible material, the web being essentially rectangular in cross section so that it includes a pair of major axes, the support elements being arranged such that the parallel sections and one of the axes of the interconnected integral webs of all the support elements are positioned essentially on a radius with respect to the axis of the semicircular section in their normal uncompressed position and such that the support section of each support element is spaced from the next adjacent support element by a distance sufficient to accommodate compression of the semicircular section, so that the resilient compressible material and the support elements move essentially radially upon the application of radial inward compressible forces, in order to seal around various sized pipes, whereupon during the essentially radial movement of the support elements the parallel sections and integral· webs essentially maintain their position on a radius, and radial flange sections extending outwardly from diametrically opposed positions on the semicircular section, each flange section being integral with the essentially semicircular section and including at least one rigid support element in addition to the support elements of the semicircular section, which additional support element includes a pair of essentially parallel sections on opposed sides of the flange and an integral web embedded in the compressible material and rigidly interconnected with both the parallel sections.

3. The invention of claims 1 or 2, characterized by each flange section including a plurality of rigid support elements which include a pair of essentially parallel sections on opposed sides of the flange and which include a web embedded in the compressible material and rigidly interconnected with both the sections.

4. The invention of claim 3, characterized by the seal further including a substantially planar metal plate at the terminal end of each flange to prevent outward deformation of the compressible material.

5. The invention of claims 1 or 2, characterized by the seal further including at least substantially planar metal plate at the terminal end of each flange to prevent outward deformation of the compressible material.

6. The invention of claim 5, characterized by the seal further including an end section at the terminal end of each flange, each end section extending essentially perpendicular to the flange and to each side of the flange, and a pair of spaced, resilient, compressible elements extending from one end section to the other in a generally semicircular configuration.

7. The invention of claim 6, characterized by the seal further including a metal plate at the terminal end of each flange on the inner side of each end section to prevent inward deformation of the compressible material.

8. The invention as defined in claims 1 or 2, wherein the essentially parallel support sections of the rigid support elements in the semicircular section of the seal are truncated, wedge-shaped sections whose smaller dimension is directed radially inwardly.

9. The invention as defined in either of claims 1 or 2, further including a separate seal element which is generally semicircular and comprised of a compressible, resilient material, and a pin mounted on each end of this separate seal element essentially parallel to the axis of the separate seal.

10. A seal and block assembly for use in a blowout preventer comprising:

a block member of substantially incompressible material for retaining and supporting the seal assembly in the blowout preventer, the block being generally annular shaped and semicircular, and including a first recess around its outer periphery at one edge thereof to define a generally semicircular surface and a generally semicircular ledge to receive and support a first seal element; and a second recess on its inner surface to receive and support a second seal element;

the first seal element being generally semicircular to fit within the first recess of the block; and the second seal element including a semicircular section and an outwardly directed radial flange section at each terminal end of the semicircular section, the semicircular section and the radial flange sections being comprised of a resilient, compressible material; the semicircular section including a plurality of rigid support elements, including a pair of spaced sections that are positioned on opposed sides of the semicircular seal section and that are interconnected by an integral web embedded in the compressible material, the support elements being arranged such that both the parallel sections and the interconnected integral web of all of the elements are positioned essentially on a radius with respect to the axis of the semicircular section and such that the support section of each support element is spaced from the next adjacent support element by a distance sufficient to accommodate compressio of the semicircular section so that the resilient compressible material and the support elements move essentially radially upon the application of radial inward compressible forces, in order to seal around various sized pipes, whereupon during the essentially radial movement of the support elements the parallel sections and integral webs essentially maintain their position on a radius, and each flange section including a plurality of rigid support elements in addition to the support elements of the semicircular section, which additional support elements include a pair of spaced, essentially parallel sections that are positioned on opposed sides of the flange and that are rigidly interconnected by an integral web embedded in the compressible material.

11. A seal and block assembly for use in a blowout preventer, comprising:

a block member of substantially incompressible material for retaining and supporting the seal assembly in the blowout preventer, the block being generally annular shaped and semicircular, and including a first recess around its outer periphery at one edge thereof to define a generally semicircular surface and a generally semicircular ledge to receive and support a first seal element; and a second recess on its inner surface to receive and support a second seal element;

the first seal element being generally semicircular to fit within the first recess of the block; and the second seal element including a semicircular section and an outwardly directed radial flange section at each terminal end of the semicircular section, the semicircular section and the radial flange sections being comprised of a resilient, compressible material; the semicircular section including a plurality of rigid support elements, which are radially positioned and circumferentially spaced from each other, each support element including a pair of spaced sections that are positioned on opposed sides of the semicircular seal section and that are interconnected by an integral web embedded in the compressible material; and each flange section including a plurality of rigid support elements which include a pair of spaced sections that are positioned on opposed sides of the flange and that are interconnected by an integral web embedded in the compressible material, each flange of the second seal element including an opening there through essentially parallel to the sealing face thereof adjacent the ends of the flange and in alignment with a corresponding opening in the block; and the first seal element including a pin adjacent each end thereof and extending essentially perpendicular to the plane thereof to fit through a corresponding opening in the second seal element and the block.

12. The invention of claims 10 or 11 characterized by the first seal element further including a substantially planar metal plate at the terminal end of each flange to prevent deformation of the compressible material.

* * * * *